US010016074B1

(12) United States Patent
Finnegan et al.

(10) Patent No.: US 10,016,074 B1
(45) Date of Patent: Jul. 10, 2018

(54) SELF-DEPLOYING MERCHANDISE DISPLAYS

(71) Applicant: Switchmate Home LLC, Pleasanton, CA (US)

(72) Inventors: Dean Finnegan, Pleasanton, CA (US); Chia-Jung Lin, San Jose, CA (US)

( * ) Notice: Subject to any disclaimer, the term of this patent is extended or adjusted under 35 U.S.C. 154(b) by 0 days.

(21) Appl. No.: 15/402,187

(22) Filed: Jan. 9, 2017

(51) Int. Cl.

| | |
|---|---|
| ***A47F 5/10*** | (2006.01) |
| ***B65D 5/66*** | (2006.01) |
| ***B65D 25/20*** | (2006.01) |
| ***A47F 5/00*** | (2006.01) |

(52) U.S. Cl.
CPC ..... *A47F 5/10* (2013.01); *A47F 5/0025* (2013.01); *B65D 5/66* (2013.01); *B65D 25/205* (2013.01)

(58) Field of Classification Search
CPC ..... A47F 5/0025; A47F 5/10; B65D 5/64; B65D 5/66; B65D 5/6697; B65D 25/205
See application file for complete search history.

(56) References Cited

U.S. PATENT DOCUMENTS

| | | | | | |
|---|---|---|---|---|---|
| 988,944 | A * | 4/1911 | Lincoln | B65D 25/54 | 217/58 |
| 1,762,900 | A * | 6/1930 | Todd | B65D 5/5246 | 206/45.28 |
| 2,524,191 | A * | 10/1950 | Ettlinger, Jr. | A45C 13/34 | 206/45.28 |
| 3,713,578 | A * | 1/1973 | Johnson | B65D 5/6697 | 16/225 |
| 4,706,330 | A * | 11/1987 | Sampson | A62C 2/245 | 16/48.5 |
| 6,772,479 | B2 * | 8/2004 | Hinkley | E05D 1/02 | 16/225 |

FOREIGN PATENT DOCUMENTS

| | | | | |
|---|---|---|---|---|
| GB | 15435 | A * | 7/1909 | |
| GB | 186543 | A * | 10/1922 | B65D 5/6697 |
| WO | WO 2010012350 | A1 * | 2/2010 | B65D 85/1036 |
| WO | WO 2013178862 | A1 * | 12/2013 | B65D 5/66 |

* cited by examiner

*Primary Examiner* — Bryon Gehman

(57) ABSTRACT

Merchandise displays including headboards that self-deploy under the action of a shape memory alloy actuator, display systems incorporating them, and methods of merchandising and displaying merchandise employing self-deploying displays.

14 Claims, 6 Drawing Sheets

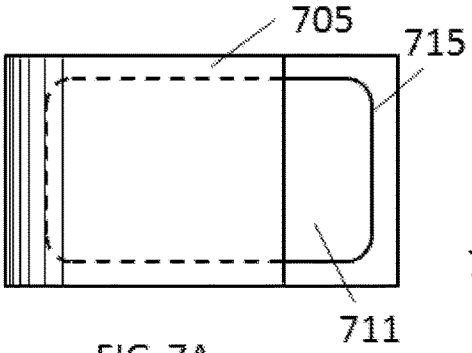
FIG. 7A
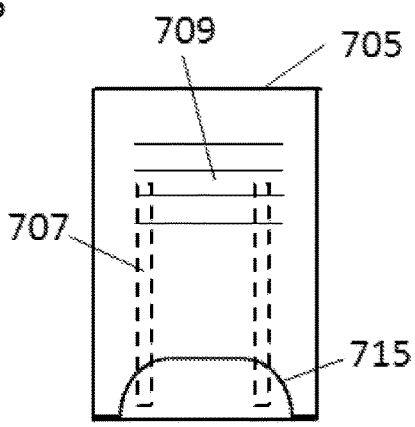
FIG. 7D
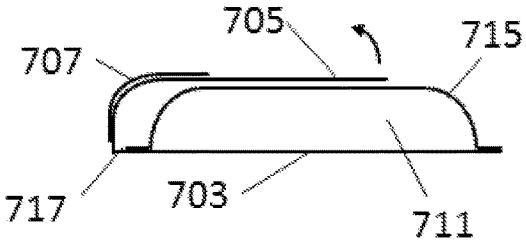
FIG. 7B
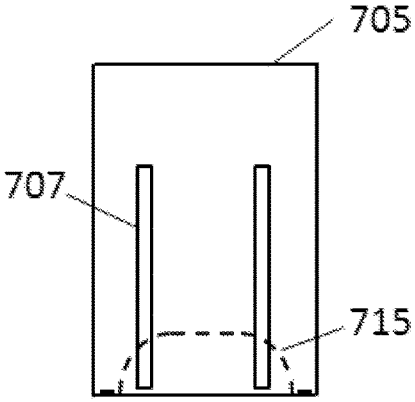
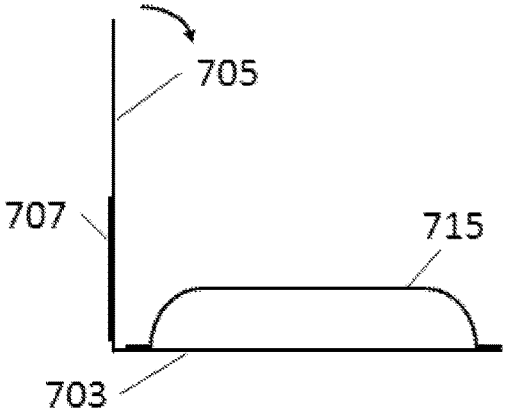
FIG. 7C
FIG. 7E

SELF-DEPLOYING MERCHANDISE DISPLAYS

BACKGROUND

Retail merchandise display space is a scarce and valuable resource. This is especially true of "point of purchase" (POP) space at or near customer checkout stations. Optimal use of display space is a key factor in successful retail merchandising. In particular, it is desirable to maximize the tendency of a display to attract customers' attention to the product, often in the presence of tightly limited space constraints amid cluttered and distracting surroundings. Other goals include minimizing complexity and setup and maintenance effort required, keeping in mind the necessity of relying on busy store personnel whose priorities may lie elsewhere.

Customer attention to a product display may be influenced by a variety of physical considerations, such as, for example, the size of the display, the surface area presented, the orientation of surfaces relative to the customer's line of sight, the geometric design, the colors employed, and the proximity to the customer's position.

In many applications, it is desirable to provide a product display modality that increases the attention-getting display area presented to the customer and better orients it relative to the customer's line of sight, while minimizing the display footprint and eliminating or minimizing required setup and maintenance effort.

Existing merchandise displays commonly entail either extracting individual product packages from a larger box by hand and arranging them on shelves or on hooks, or cutting away part of the larger box and placing the entire box in the display location. The former approach is labor intensive and leaves the door open to disarrangement of merchandise by customers and insufficiently careful placement by employees; the latter tends to limit the visibility of the merchandise and/or packaging.

Among other embodiments and innovations and by way of example only, disclosed herein are merchandise display modules that self-deploy from a compact configuration convenient for shipping and/or storage to an extended or deployed configuration suitable for merchandise display, with minimal or no human intervention required. More generally, in embodiments as disclosed, merchandise displays may thus be provided with movable components that self-deploy to a pre-determined position when removed from a carton or container or otherwise released from constraints against movement.

This deployment may be actuated actively, such as by a motor or solenoid, or passively, such as by a spring. Active actuation is impracticably expensive, complex, and unreliable for typical merchandise display applications. Commonly available passive components are unsatisfactory on several dimensions. Ordinary metal spring materials deform irreversibly if subjected to large strains, such as, for example, bending through a large angle over a short distance. Thus to actuate movement of a component through a large angle it is necessary to resort to configurations such as coil springs so as to distribute the bending strain over much greater length, requiring relatively large and unsightly components and leading to increased manufacturing costs and complexity. Also, display modules may typically remain in shipping cartons for extended periods of time, during which small spring components kept under constant load may lose elasticity and fail to fully self-deploy.

In embodiments as disclosed herein, these disadvantages are overcome by employing actuators taking advantage of the properties of certain shape memory alloy (SMA) materials to provide the high elasticity needed in a component that is simple, compact, and inexpensive to manufacture.

It is well known that SMA materials such as, for example, nitinol, have a property known as "shape memory", wherein an SMA component can be fabricated to have a thermally-set shape. At lower temperatures, the SMA material can be readily deformed into another shape, but when the SMA material is heated it returns to the thermally-set shape. Although shape memory effects can be exploited to produce movement in an actuator, doing so entails applying heat, introducing undesirable complexity.

However, in addition to their shape memory properties, some SMA materials, when fabricated with the correct alloy composition and employed within the correct temperature range and other conditions as disclosed herein, also exhibit the property of superelasticity. Unlike most commonly used metals, which deform irreversibly if bent beyond a relatively small deflection, superelastic materials can be fabricated that are capable of tolerating very large deformations while retaining the ability to recover their original undeformed shape upon release of the deforming load.

In the context of the merchandise display applications here under consideration, the inventors have found that this increase in elasticity is sufficient to obviate the need for bulky or complicated spring actuators, enabling the production of self-deploying display components using spring actuators of simple design and low cost, and greatly simplifying manufacture of the display modules.

SUMMARY

In general, provided herein are embodiments of novel methods, systems, devices, apparatus, compositions, articles of manufacture, and improvements thereof useful for display of merchandise, such as for sale to customers. The disclosures hereof are of particular utility for retail displays and point of purchase displays.

In an aspect of the disclosure hereof, there are provided embodiments of a self-deploying merchandise display module, which may include an enclosure defining an enclosing space for enclosing an article of merchandise; a headboard positionable in either of an undeployed configuration (such as, for example, a compact arrangement for shipping or storage) or a deployed configuration (such as, for example, a position in which the headboard extends upward or outward for visibility); and at least one spring actuator including a shape memory alloy (SMA) material engaging the headboard so that positioning of the headboard in the retracted position deforms the spring actuator producing a biasing force, so that the headboard is positionable from the retracted position to the deployed position by the action of the spring actuator. In embodiments, the SMA material may include a superelastic material.

In another aspect, there are provided embodiments of a merchandise display system for deploying and displaying a plurality of self-deploying merchandise display modules which may be disposed in an outer container, wherein the merchandise display modules may be disposed within the outer container with their headboards in their retracted configuration. The outer container may be provided with a cover or closure and/or the headboards of the merchandise display modules may be constrained against deploying by the outer container and/or its cover or closure, and upon opening or removal of the cover or closure the headboards may self-deploy to their deployed positions by the action of the SMA spring actuators.

In another aspect, there are provided embodiments of a method of displaying merchandise, including disposing an article of merchandise in a self-deploying merchandise display module, and/or optionally disposing a merchandise display module having an article of merchandise disposed therein, in a merchandise display system.

In embodiments, an object of the present disclosure is to improve and/or maximize the visibility and/or attention-getting character of a merchandise display, within the constraints of the available display footprint, location, and position.

In embodiments, an object of the present disclosure is to minimize the labor required to set up, maintain, and restock a merchandise display.

In embodiments, an object of the present disclosure is to reduce the opportunity for careless or improper setup of a merchandise display and/or disarrangement by customers or stockers.

In embodiments, an object of the present disclosure is to optimize product and/or message exposure in space-limited point of purchase displays.

In embodiments, an object of the present disclosure is to provide display modalities providing improved brand identification, product differentiation, and consumer attention.

In embodiments, an object of the present disclosure is to increase the motivation of retailers to display a product prominently and/or allocate preferred display space.

In embodiments, an object of the present disclosure is to minimize or reduce packing size of a packaged product for efficient transport and/or storage.

In embodiments, an object of the present disclosure is to provide a merchandising display with a self-deploying headboard for use in a merchandising display such as a retail or point of sale display.

In embodiments, an object of the present disclosure is to provide a merchandising display with self-deploying features of reduced complexity and/or increased reliability and useful life.

In embodiments, an object of the present disclosure is to provide, for use in a self-deploying feature of a merchandising display, an actuator having superior function, actuating force, simplicity, cost, convenience of manufacture, and/or useful life.

It will be apparent to persons of skill in the art that various of the foregoing aspects and/or objects, and various other aspects and/or objects disclosed herein, can be incorporated and/or achieved separately or combined in a single device, method, system, composition, article of manufacture, and/or improvement thereof, thus obtaining the benefit of more than one aspect and/or object, and that an embodiment may encompass none, one, or more than one but less than all of the aspects, objects, or features enumerated in the foregoing summary or otherwise disclosed herein. The disclosure hereof extends to all such combinations. In addition to the illustrative aspects, embodiments, objects, and features described above, further aspects, embodiments, objects, and features will become apparent by reference to the drawing figures and detailed description. Also disclosed herein are various embodiments of related methods, devices, apparatus, compositions, systems, articles of manufacture, and/or improvements thereof. The foregoing summary is intended to provide a brief introduction to the subject matter of this disclosure and does not in any way limit or circumscribe the scope of the invention(s) disclosed herein, which scope is defined by the claims currently appended or as they may be amended, and as interpreted by a skilled artisan in the light of the entire disclosure.

BRIEF DESCRIPTION OF THE FIGURES

FIG. 7A depicts schematically in plan view another example embodiment consistent with the disclosure hereof of a merchandise display module with a headboard in a position adjacent to the merchandise enclosing space.

FIG. 7B depicts schematically a left side view of another example embodiment consistent with the disclosure hereof of a merchandise display module with a headboard in a position adjacent to the merchandise enclosing space.

FIG. 7C depicts schematically a left side view of another example embodiment consistent with the disclosure hereof of a merchandise display module with a headboard in a position extended upward relative to the merchandise enclosing space.

FIG. 7D depicts schematically a front view of another example embodiment consistent with the disclosure hereof of a merchandise display module with a headboard in a position extended upward relative to the merchandise enclosing space.

FIG. 7E depicts schematically a rear view of another example embodiment consistent with the disclosure hereof of a merchandise display module with a headboard in a position extended upward relative to the merchandise enclosing space.

Figures are not to scale unless expressly so labeled, and relative positions and orientations of objects and components are illustrative and not limiting except where expressly so stated. Persons of skill in the art will recognize that many other arrangements, configurations, dimensions, orientations, and selections of components are possible and consistent with the disclosure hereof, and are in no way limited to the embodiments shown in the figures.

DETAILED DESCRIPTION

In general, disclosed herein are novel methods, systems, compositions, and articles of manufacture useful for displaying merchandise effectively and efficiently using display and/or packaging modalities that fully or partially self-deploy from a configuration suitable for storage and/or transport to a configuration suitable for display. These may be found useful in any setting where merchandise is to be displayed, such as, for example, in retail displays and particularly in point of purchase displays.

Figure 1:
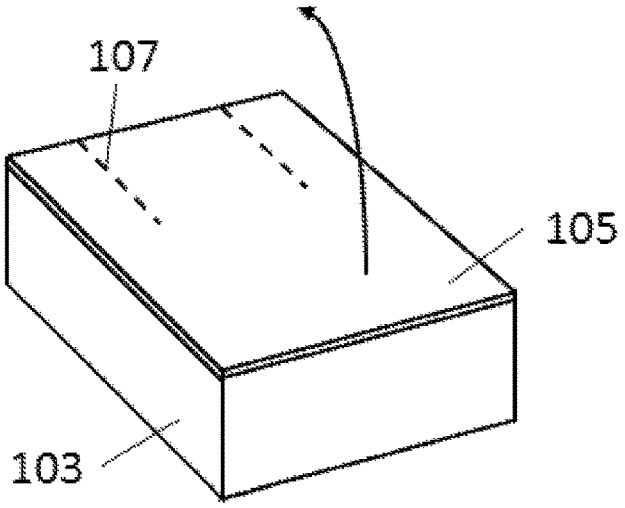
FIG. 1 shows a schematic depiction of a perspective view of an example embodiment consistent with the disclosure hereof of a merchandise display module with a headboard in a first position.
Figure 2:
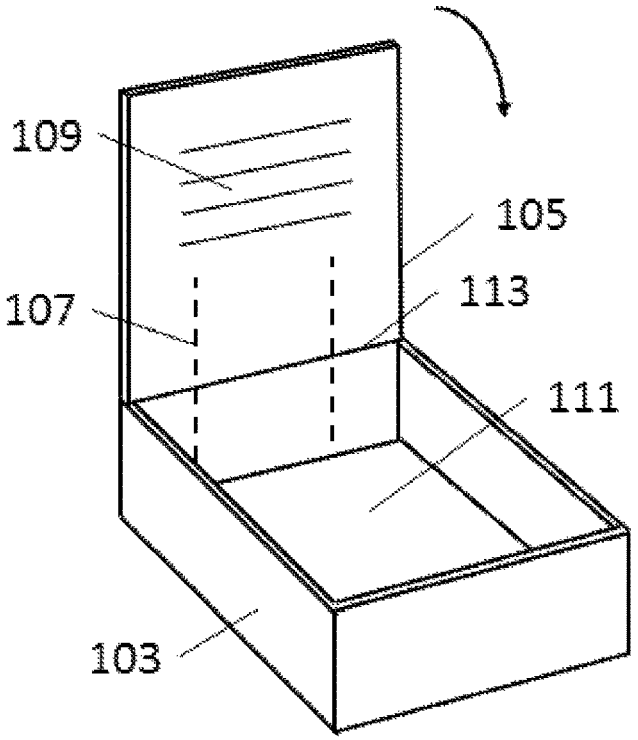
FIG. 2 shows a schematic depiction of a perspective view of an example embodiment consistent with the disclosure hereof of a merchandise display module with a headboard in a second position, extended outward relative to the merchandise enclosing space.

FIGS. 1 and 2 illustrate general features of an example embodiment of a self-deploying merchandise display module. An enclosure 103 defines an enclosing space 111 in which a product may be placed. A headboard 105 is hinged 113 to the enclosure allowing it to be positioned in either an undeployed configuration such as shown in FIG. 1, wherein the headboard is positioned to extend laterally adjacent to the enclosing space, or in a deployed configuration such as shown in FIG. 2, wherein the headboard is positioned to extend upward. The headboard may include a message region 109 for displaying a graphic, logo, text, or other information. In the example embodiment shown in FIGS. 1 and 2, the message region of the headboard would not be visible when the headboard is in the compact configuration. When the headboard is deployed to the extended configuration, the message region becomes visible, is oriented in a more preferable orientation approximately perpendicular to the line of sight of a customer viewing the display from the front, and the effective message area visible to the customer is increased. Deployment of the headboard to the extended position may also, if desired, be made to expose the contents of the enclosing space so that, for example, merchandise contained therein is made visible. An undeployed configuration may include a more compact configuration as compared to the deployed configuration, such as may be useful for packaging the merchandise display modules for storage or transport.

In the example embodiment shown in FIGS. 1 and 2, there are provided one or more spring actuators 107. Absent external forces or constraints, these assist in maintaining the headboard in the extended configuration by resisting forward and/or backward movement of the headboard. In embodiments, as explained in greater detail below, it may be found useful to employ a spring actuator composed in whole or part of a shape memory alloy (SMA) exhibiting superelastic behavior under the conditions of intended use. In embodiments, positioning of a headboard in the undeployed position induces an opposing force in a spring actuator sufficient to reposition the headboard in a deployed position when the headboard is released. A headboard may be maintained in a undeployed position in any manner operable to prevent or resist its movement, such as, for example, by placing the merchandise display module in another container, or via a fastener, tape, or other component operable to hold the headboard in the undeployed position.

An enclosure and/or headboard of a self-deploying merchandise display module may be fabricated in any size, geometry, material, composition, and/or arrangement of components operable to contain and display merchandise in an application of interest. For example, an enclosure 803 could be composed in whole or part of one or more of any desired packaging material such as card stock, corrugated cardboard, or plastic, which may be formed in any shape or combination of shapes found useful for enclosing merchandise of interest. In some embodiments enclosure designs should preferably minimize cost and optimize efficiency of manufacture and produce an attractive and durable package consistent with marketing goals. In embodiments, an enclosure and/or headboard and/or portion of either may be transparent, partially transparent or opaque, or non-transparent, and may be of any color or combination of colors and any desired visual design. In embodiments, an enclosure and/or headboard and/or any one or more portions of either may be fabricated from a single piece or assembled from two or more pieces or in any other manner, which may include cutting, folding, gluing, molding, stapling, riveting, and/or any other desired mode of assembly. In general, the construction, fabrication, and aesthetic design of the enclosure and headboard may extend to any of the very large repertoire of techniques and modalities familiar to persons of skill in the art and science of merchandising and packaging, as currently known or developed in the future, subject only to the constraints arising from the geometric, mechanical, and other requirements of the self-deployment features of the merchandise display module as disclosed herein. It will be apparent that the characterization of the components of the merchandise display module in terms of an enclosure and headboard is somewhat arbitrary and that the boundary between the two may be inexact; in embodiments, as used herein, "headboard" refers to the deployable portion of a merchandise display module, i.e. that portion whose position and/or geometry is altered upon self-deployment as disclosed herein, and "enclosure" refers to the remainder of the module. In typical embodiments, a merchandise display module may be configured whereby the enclosure portion is adapted to hold an article of merchandise; however, it would also be possible for one or more articles of merchandise to be attached to, contained in, otherwise associated with a headboard.

Figure 3:
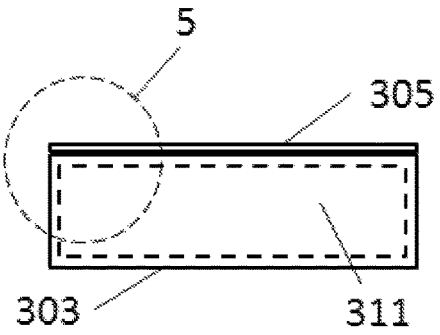
FIG. 3 shows a left side schematic view of another example embodiment consistent with the disclosure hereof of a merchandise display module with a headboard in a position adjacent to a merchandise enclosing space.
Figure 4:
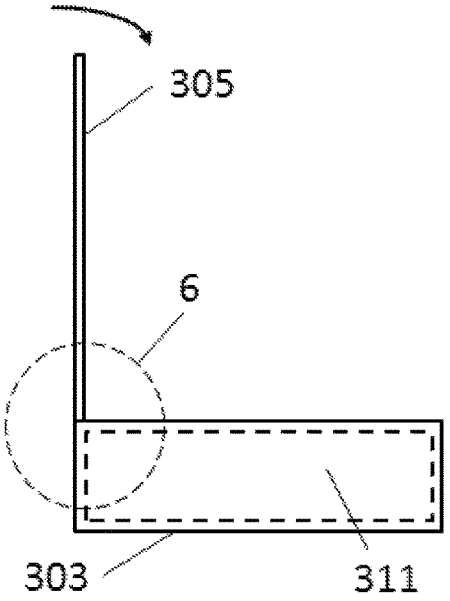
FIG. 4 shows a left side schematic view of an example embodiment consistent with the disclosure hereof of a merchandise display module with a headboard in a position extended outward relative to a merchandise enclosing space.

By way of illustrating the broad variety of useful applications in which the innovations disclosed herein may be incorporated, examples of several alternative designs of self-deploying merchandise display modules are depicted schematically in FIGS. 3-10. For example, in embodiments, an enclosure may provide a fully enclosed space for the merchandise contained therein, or may be partially open, or may be fully enclosed when covered by the headboard but partially open when the headboard is deployed to the extended configuration, or may have any other configuration and/or geometry operable to hold and/or position merchandise of interest and provide a structure relative to which a headboard can be made to self-deploy. Thus in FIGS. 1 and 2 there is depicted schematically an example embodiment in which the enclosure 103 is upwardly open, but the opening is covered by the headboard 105 when the headboard is in the undeployed position as in FIG. 1. In another example embodiment as depicted schematically in FIGS. 3 and 4, a self-deploying merchandise display module may include an enclosure 303 defining a fully closed enclosing space 311 for containing one or more articles of merchandise, with the undeployed position of the headboard 305 extending laterally over the upper portion of the enclosure as shown in FIG. 3. In another example embodiment as depicted schematically in FIGS. 7A-7E, an enclosure could be fabricated having a flat backing 703 such as, for example, of card stock, plastic sheet, or other sheet material, and a covering portion 715 such as, for example, a molded plastic bubble or vessel, which could be constrained to the flat backing by an adhesive, by folding the edges of the covering portion around the edges of the flat backing or vice versa, by plastic welding, by one or more fasteners, or in any other manner operable to establish an enclosing space 711 for merchandise or other structure operable to hold merchandise. In embodiments, an article of merchandise could be affixed directly to a flat backing, such as, for example, by wire ties, and the covering portion could be dispensed with. In embodiments as illustrated in FIGS. 7B and 7C, the headboard 705 could be of a piece with the flat backing, or could be attached directly or via any other component to the flat backing or any other portion of the enclosure in any manner operable to provide an attachment and allow positioning of the headboard in the desired undeployed position and deployment of the headboard to the deployed position under the action of the spring actuator 707. In embodiments, as illustrated in FIG. 7B, an enclosure could include an extension 717 or other component to which a headboard could be affixed or mounted.

Figure 10:
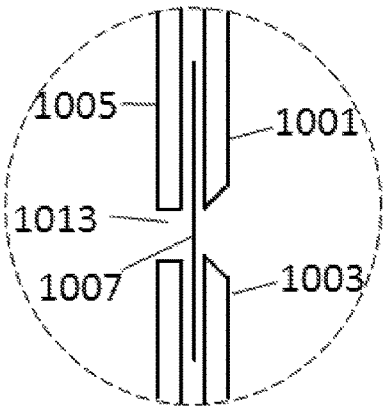
FIG. 10 shows enlarged sectional view of a hinge region of another example embodiment consistent with the disclosure hereof of a merchandise display module with a headboard in a position extended outward relative to the merchandise enclosing space.
Figure 13:
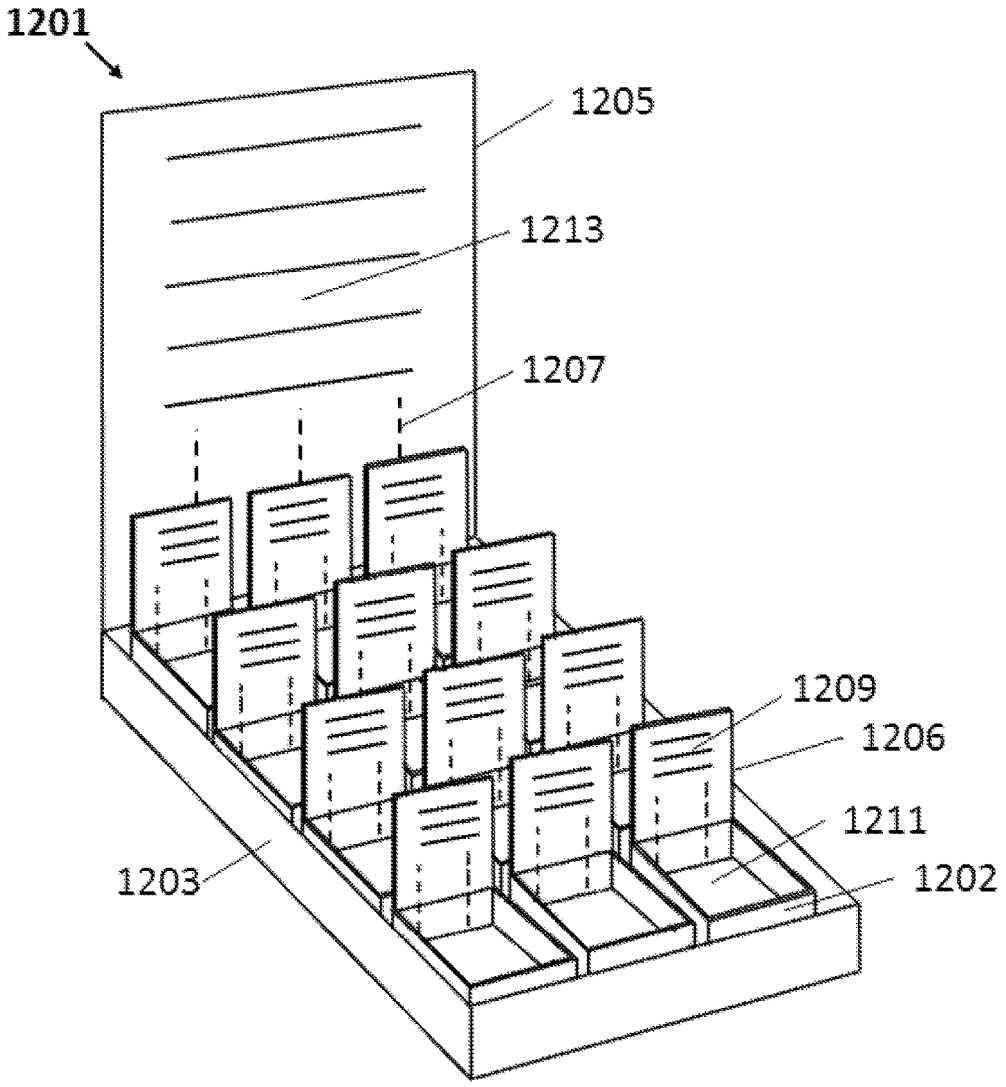
FIG. 13 shows an example embodiment consistent with the disclosure hereof of a merchandise display system in a deployed configuration.

In embodiments, a headboard may be fabricated of any one or more materials, in any combination of pieces and/or components, and in any geometry, aesthetic design, or other characteristics consistent with merchandising goals and operable for the use intended. In some embodiments, a headboard should preferably include one or more message regions, any of which may be or include a portion of or be integral with the headboard or may include one or more other components attached or associated with the headboard in any manner deemed useful. Message regions may be positioned and disposed for good visibility to customers when the headboard is in its deployed position and the self-deploying merchandise display module is placed as in an intended position and configuration for use. Thus, in embodiments wherein self-deploying merchandise display modules are intended to be placed in a relatively flat and upwardly open display, such as, for example, as depicted in FIG. 13, it may be found useful to employ a design wherein the headboards when deployed are in a vertical or slightly backwardly angled orientation with a message panel on the forwardly facing portion of the headboard, so as to maximize the visible area as viewed by a customer facing the display, and so as to present the content of the message panel approximately perpendicular to the customer's line of sight. In embodiments, a headboard need not necessarily be flat or two-dimensional. Thus, for example, a headboard could be or include a three-dimensional component, such as molded plastic, or folded or bilayer card stock, corrugated paper, or plastic, such as illustrated in FIG. 10. In embodiments a headboard could be provided with a hole, hook, or other feature such as for convenient disposition on a pegboard type display.

Figure 5:
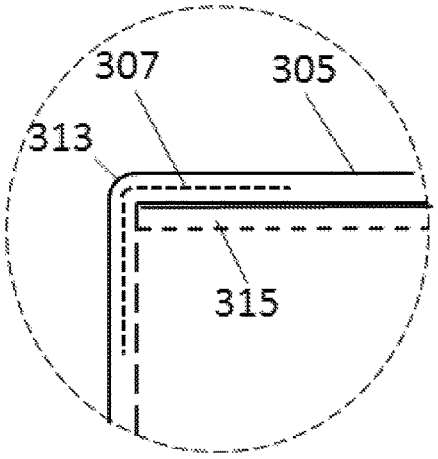
FIG. 5 shows an enlarged left side schematic view of an example embodiment consistent with the disclosure hereof of a merchandise display module with a headboard in a position adjacent to a merchandise enclosing space.
Figure 6:
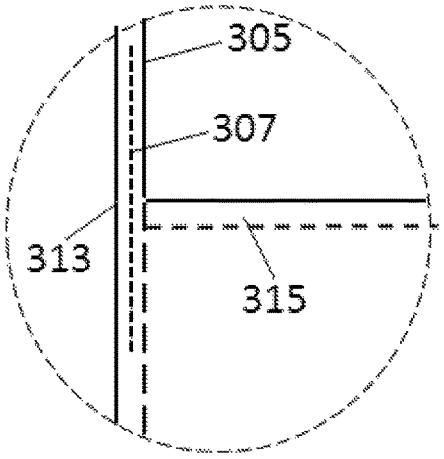
FIG. 6 shows an enlarged left side schematic view of an example embodiment consistent with the disclosure hereof of a merchandise display module with a headboard in a position extended outward relative to a merchandise enclosing space.
Figure 8:
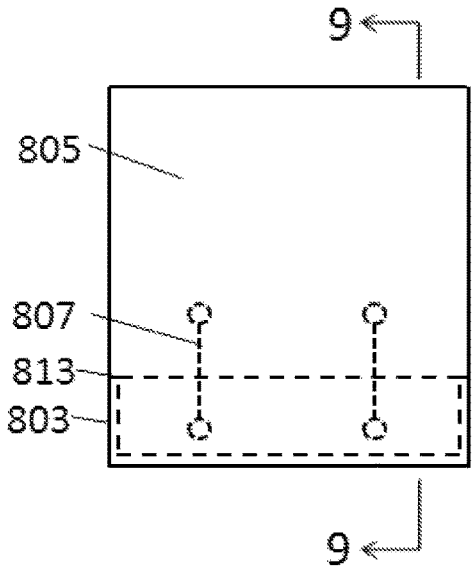
FIG. 8 shows a rear side schematic view of another example embodiment consistent with the disclosure hereof of a merchandise display module with a headboard in a position extended upward relative to the merchandise enclosing space.
Figure 9:
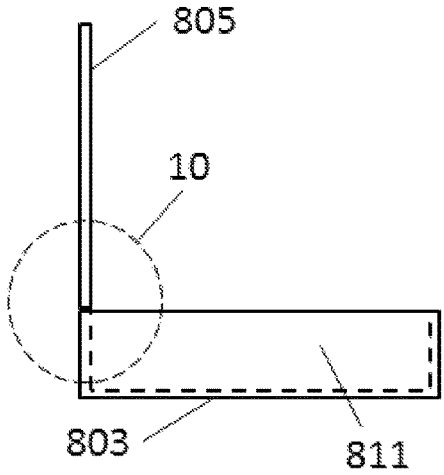
FIG. 9 shows schematically a sectional view of the example embodiment of FIG. 8 consistent with the disclosure hereof of a merchandise display module with a headboard in a position extended upward relative to the merchandise enclosing space.

A headboard may be disposed in any relationship to an enclosure or other portion of a self-deploying merchandise display module found useful in an application of interest, and there may be employed any geometry, deployed position, un-deployed position, point of attachment, orientation, and/or direction of motion reasonably allowing for self-deployment in accordance with the disclosure hereof. For example, in embodiments, a headboard may be hinged or flexibly mounted directly or indirectly to a portion of an enclosure or other component, such as shown schematically in FIGS. 1 and 2; in some embodiments, as shown in FIGS. 5 and 6, a headboard may be integral with or a continuation of a portion of an enclosure or other component. In embodiments, a headboard may be positionably mounted to an enclosure, which may include any mounting or association of a headboard with an enclosure (or other component affixed to or associated with an enclosure) of a self-deploying merchandise display module operable to provide adequate freedom of motion of the headboard from its un-deployed position to its deployed position under the action of one or more spring actuators. For example, a hinge or flexible joint could be employed, or, as illustrated in FIGS. 5 and 6 a headboard and or a component to which the headboard is attached or integrated could include a flexible region 313 permitting the desired motion, or, as illustrated in FIGS. 7B and 7C, positioning the headboard to its un-deployed position could include bending or warping the headboard itself, or, as illustrated in FIG. 10, a gap 1013 could be provided between a headboard 1005 and an enclosure or other component relative to which the headboard is to move, and the required hinging functionality and freedom of motion could be provided the spring actuator(s) 1007.

The deployed and/or undeployed positions of the headboard may include any positions found useful for an application of interest. Although the examples illustrated in the drawing figures show headboards whose undeployed position is displaced generally down and over an enclosure and whose deployed position extends generally upward relative to the rearward end of an enclosure, the innovative methods and components disclosed herein are readily applied to any other configurations wherein it is desired to provide self-deployment of a portion of a merchandise display module relative to an enclosure or other component thereof. Thus in accordance with the disclosures hereof, a headboard could be disposed to self-deploy from a side or front of a merchandise display module, and/or from any location relative to any surface of an enclosure, and/or in any orientation and/or any direction.

In embodiments, a headboard of a self-deploying merchandise display module may be adapted and configured to self-deploy from an undeployed position to a deployed position under the action of one or more spring actuators. In some embodiments, self-deployment may be made to trigger any other events or actions deemed useful in an application of interest, and a self-deploying merchandise display module may be provided with one or more switches, sensors, and/or controls for detecting self-deployment of a headboard and triggering or controlling a response thereto. For example, a module could be configured so that self-deployment of a headboard activates a switch or sensor causing a light display or other electrically powered component to be activated, thereby allowing, for example, battery powered functionality without battery drain during storage and without requiring affirmative action by stockers to activate it.

In embodiments, a spring actuator may be of any shape, size, and/or geometry and mounted to and/or engaged with any portions of a self-deploying merchandise display module in any manner operable singly or in combination with other spring actuators to deploy a headboard from an undeployed position to a deployed position. A significant advantage provided by the use of superelastic SMA materials for spring actuators for self-deploying merchandise display modules is that because such materials can retain full elasticity under much greater deformation than normal metals, they can tolerate a much smaller bending radius without undergoing plastic deformation or fracture and while maintaining elasticity over a large angular displacement, making it possible to employ simple spring actuator configurations that are inexpensive and allow for simpler fabrication. SMA materials are commercially available in a variety of alloy compositions, sizes, and geometries, such as, for example, in the form of wire, ribbon, or sheet. Thus, for example, in some embodiments such as illustrated in FIGS. 1 and 2, a spring actuator may consist of or include a suitable length of SMA wire 107 with a portion of the wire mounted to engage at one end with an enclosure or associated component thereof, and at the other with a headboard. In some embodiments, as illustrated in FIGS. 7D and 7E, a spring actuator could consist of or include a strip of SMA ribbon of appropriate dimensions.

In some embodiments, such as illustrated in FIGS. 5 and 6, a wire, ribbon, or other similar SMA spring actuator could be inserted or embedded in the material of a headboard and/or enclosure. In some embodiments, as illustrated in FIGS. 7B and 7C, a wire, ribbon, or other similar spring actuator could be affixed to a surface of a headboard or other component in any effective manner such as by an adhesive, tape, or fastener. In some embodiments, a spring actuator may be a simple spring element or may include a simple spring element as the source of its biasing force. As used herein, a simple spring refers to a spring wherein the overall longitudinal bend of the elastic material in normal use does not exceed about 180 degrees, as distinguished from a coil spring, serpentine spring, or other similar geometry for spreading the overall bend over a length of elastic material substantially greater than the overall length of the spring. Examples of simple springs could include the wire or ribbon springs illustrated in FIGS. 1, 2, 5, 6, 7B, and 7C.

Figure 11:
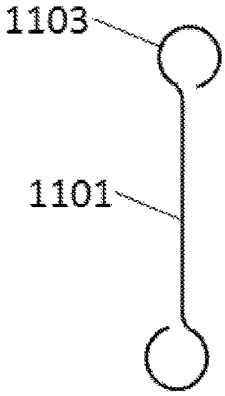
FIG. 11 shows schematically an example embodiment of an actuator consistent with the disclosure hereof.

In some embodiments as illustrated in FIG. 10, a spring actuator 1007 could be mounted between the layers 1001, 1005 of a folded or bilayer material of a headboard or other component or inserted in the corrugations of a corrugated paper material. In some embodiments as illustrated in FIG. 11, it may be found useful to provide a spring actuator 1101 with one or more loops 1103, bends, or other shape modifications, such as to prevent rotation, better secure the ends of the spring actuator, prevent longitudinal and/or lateral movement of the spring actuator, and/or prevent penetration or tearing of the material of a headboard or other component by sharp wire or ribbon ends. Although in many applications a spring actuator composed solely of SMA wire, ribbon, or other SMA material may be found fully adequate, in some embodiments, a spring actuator could include non-SMA material, such as, for example, a plastic or other coating or an end cap applied to an SMA wire or ribbon. In embodiments, a spring actuator may include an actuating portion positioned and/or mounted so as to engage a headboard or portion thereof, and an anchoring portion could be positioned and/or mounted to engage any portion of the self-deploying merchandise display module operable to provide a suitable opposing force for the movement of the headboard under the action of the spring actuator, such as, for example, mounted to an enclosure or portion thereof or component affixed thereto or associated therewith, or to a proximal portion of a flexible headboard.

In embodiments, SMA spring actuators may be found particularly advantageous for use due to the ability of appropriately selected SMA materials to exhibit superelastic behavior. In many applications of the kind disclosed herein, a non-SMA metal spring of similar size and geometry would be inoperable because positioning a headboard in the undeployed position would cause irreversible deformation of the spring actuator and render it incapable of returning the headboard to the deployed position. In embodiments, because of the very much greater capacity of a superelastic SMA material to accommodate strain, simple wire or ribbon type SMA spring actuators may be able to maintain their elasticity and avoid plastic deformation despite very large bending strain, thereby accommodating relatively large motion of a headboard, such as, for example a deflection of a headboard between an undeployed position and a deployed position through an angle of at least about 45 degrees, or at least about 60 degrees, or at least about 75 degrees, or at least about 90 degrees, or at least about 105 degrees. Further, in embodiments, a simple wire or ribbon type SMA spring actuator may be able to maintain elasticity and avoid plastic deformation in applications, such as that illustrated schematically in FIG. 5 or FIG. 10, where positioning a headboard in an undeployed position entails bending a spring actuator over a bending radius too small to be accommodated by an ordinary metal of similar dimensions and geometry without irreversible deformation, such as, for example, a bending radius less than about 3 cm, or less than about 2.5 cm, or less than about 2 cm, or less than about 1.5 cm, or less than about 1 cm, or less than about 0.5 cm. In some embodiments, a simple wire or ribbon type SMA spring actuator may be employed having a ratio of bend diameter to wire or ribbon thickness of less than about 10 to 1, or less than about 12 to 1, or less than about 15 to 1, or less than about 20 to 1, or less than about 24 to 1, or less than about 33 to 1, or less than about 50 to 1.

For reliable functioning of a SMA spring actuator, in some embodiments, attention should be paid to design of the geometry and dimensions of the self-deploying merchandise display module and its components and the dimensions and composition of the SMA spring actuator so as to provide sufficient restoring force to move a headboard from its undeployed position to its deployed position, while avoiding strains exceeding the maximum recoverable strain limit of the SMA material. Maximum recoverable strain refers to the level of strain above which irreversible plastic deformation or fracture is expected to occur. The maximum recoverable strain for appropriately selected SMA materials is in the range of 8 to 10 percent, as compared to a maximum of approximately 0.5 percent for non-SMA metals. For simple wire or ribbon spring actuators, the relationship between bending radius to outer surface strain may be estimated as indicated in Table I. For other geometries the pertinent constraints can be estimated or determined by testing.

TABLE I

Approximate Surface Strains vs. Bending Radius

| Outer surface strain | Ratio of bending radius to wire diameter |
|---|---|
| 4% | 11.9 |
| 6% | 7.74 |
| 8% | 5.64 |
| 10% | 4.41 |

(Source: Johnson Matthey Medical Components, Surface Strains in Nitinol Wire, Ribbon, and Sheet, jmmedical.com/resources/271/Surface-Strains-in-Nitinol-Wire-Ribbon-and-Sheet.html.) Thus, for example, taking 4% strain as a reasonable limit to allow a margin of safety, a SMA spring actuator of 0.5 mm diameter wire or 0.5 mm thickness ribbon could be expected to retain its elasticity and restoring force over its full range of deflection as long as the bend radius does not exceed about 6 mm. (In applications where a smaller margin of safety can be tolerated, correspondingly smaller bending radius limits may be accommodated.) By way of comparison, a similarly sized ordinary metal wire or ribbon would be expected to undergo plastic deformation and failure at any bend radius smaller than about 50 to 100 mm.

Superelastic characteristics of SMA materials may depend on a number of factors such as, for example, the alloy used, the temperatures to which the component is to be subjected, work-hardening or other treatment of the metal if any, the load applied, the sizing and geometry of the component, the deformation to be applied, and the fatigue resistance requirements. Not all SMA materials are superelastic, and for those that are the quality of the superelastic behavior will depend in part upon correct selection of material based on temperature characteristics. It may be found desirable in selecting an appropriate material to perform testing of candidate materials in the intended use configuration. Nevertheless, without being bound by theory, it may be found helpful to take into account typical characteristics of SMA compositions in specifying and selecting suitable materials.

The normal elastic behavior of metals is mainly attributed to bond stretching, so that larger deformations result in bond breaking and irreversible plastic dislocation or fracturing. Superelasticity in SMA alloys is attributed to a different mechanism, in which applied stress induces local reversible phase transformations of the metallic crystal structure from an austenitic phase to a martensitic phase. Thus superelastic materials are able to undergo deformation of much greater magnitude without plastic dislocation or fracturing, remaining elastic and retaining the ability to return to their undeformed configuration as the phase changes spontaneously reverse themselves when the deforming stress is removed. Elastic behavior may be retained up to quite large strains of as much as about 5%, or 6%, or 7%, or 8%, or 9%, or 10%, much larger than would be tolerated by normal elastic behavior of metals, in which elasticity would be lost at strains above about 0.5% or above about 0.75%, or above about 1%. In embodiments, it may be found useful to employ spring actuators that exhibit superelasticity since this will allow simple structures such as wire or flat ribbon type springs to provide the desired elastic behavior over a large range of motion.

In general absent applied stress, SMA materials are in the austenitic phase at higher temperatures and in the martensitic phase at lower temperatures. The phase behavior of SMA materials may be characterized in part according to four temperatures: $A_s$, the austenitic transformation temperature, at which SMA material in the martensitic phase begins to transform to the austenitic phase as temperature is raised; $A_f$, the fully austenitic temperature threshold above which no further transformation to the austenitic phase occurs as temperature is raised further; $M_s$, the temperature at which material in the austenitic phase begins to transform to the martensitic phase as temperature is reduced; and $M_f$, the temperature at which no further transformation to the martensitic phase occurs as temperature is reduced further. Typically hysteresis is observed, with $M_s<A_s$. These temperatures may vary depending on experimental conditions and in particular depending on whether and to what degree they are measured while the material is under applied stress.

Since superelastic behavior is thought to result from local martensitic transformation under applied stress, it is expected to correspond to temperatures slightly above $A_f$, where the austenitic phase is thermodynamically favored but only slightly, so that applied stress can readily shift the equilibrium and bring about the local transformation. At such a temperature, the unstressed material is in its fully austenitic state, but applied stress is capable of inducing increasing degrees of local martensitic transformation, tending to maximize the range of strain that can be accommodated without plastic deformation or fracture. In general, the force needed to initiate martensitic transformation increases with increasing temperature above $A_f$. Thus to take full advantage of the superelastic properties, it may be found desirable in fabricating a spring actuator to employ an SMA material such that the temperature(s) at which the spring actuator is to operate lies toward the upper end of the superelastic temperature range of the material. Thus in some embodiments, it may be found preferable to employ an SMA material having an $A_f$ temperature less than the temperature at which the spring actuator is to be employed by about 1° C., or about 2° C., or about 4° C., or about 6° C., or about 8° C., or about 10° C., or about 20° C. Assuming a self-deploying merchandise display module or system is intended to be used at approximately room temperature (e.g. approximately 21° C.), it may be found useful to employ an SMA material having an $A_f$ temperature of less than about 21° C., or less than about 20° C., or less than about 18° C., or less than about 16° C., or less than about 14° C., or less than about 12° C., or less than about 10° C., or less than about 0° C.

An alloy composition known to exhibit superelasticity when correctly fabricated and employed at appropriate temperatures is nitinol, an alloy of nickel and titanium typically in proportions of about 53 to 56 percent nickel by weight and about 44.5 to 47 percent titanium by weight. In some formulations it is found that alloying the nickel and titanium with copper allows more precise control of the transition temperature range. Although other alloy compositions known to exhibit superelasticity include Cu—Al—Ni, Cu—Zn, Cu—Zn—Al, Ni—Hf—Ti, and Fe—Mn—Si, and these may be employed in spring actuators if desired, in many embodiments of merchandise display modules, the SMA material of choice will be nitinol wire or ribbon due to low cost and commercial availability.

Figure 12:
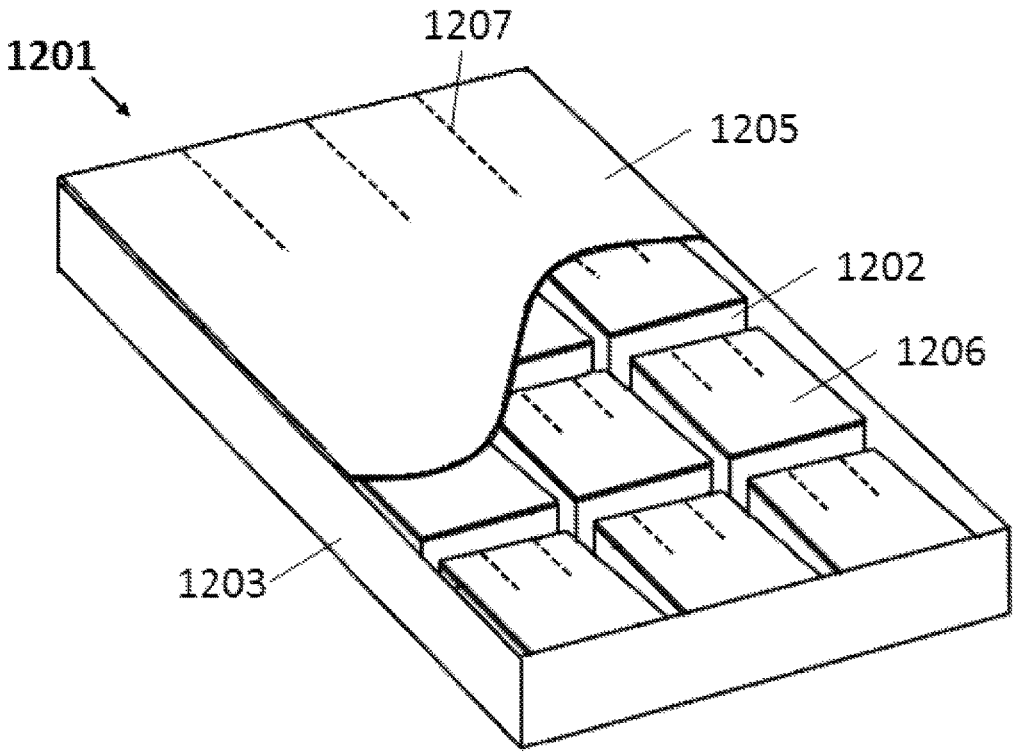
FIG. 12 shows an example embodiment consistent with the disclosure hereof of a merchandise display system in an un-deployed configuration.

A significant advantage afforded by the self-deploying headboard functionality disclosed herein is that it enables the compact packaging of multiple individual merchandise display modules in an outer carton or container for storage and/or transport, thus reducing storage and transport costs and providing easier handling. In embodiments, the headboards may be made to self-deploy upon opening of the outer container or removal of a cover or closure thereof, so that setup of a display may be greatly simplified and the opportunity for improper setup greatly reduced. Accordingly, also provided herein are embodiments of a merchandise display system which may include an outer container, and a plurality of self-deploying merchandise display modules disposed in the container with their headboards held therein in the undeployed position. In embodiments, the headboards may be held in the undeployed position in any manner operable to prevent their self-deployment, such as, for example, by closing or covering the carton or container in which the merchandise display modules are held so that the headboards are prevented from self-deploying by their enclosure within the outer carton or container. FIGS. 12 and 13 depict an example embodiment of a merchandise display system 1201 consistent with the disclosure hereof. FIG. 12 depicts a cutaway view of an outer container 1203 with the cover 1205 closed over a plurality of self-deploying merchandise display modules 1202 disposed with headboards 1206 in the undeployed position. In embodiments, the outer container may optionally be provided with spring actuators 1207, which may include SMA spring actuators, so that when the cover of the outer container is released, such as, for example, by cutting or untaping the upper front and side corners of the outer container, the cover of the outer container may self-deploy to a raised or extended position as depicted in FIG. 13. Once the cover of the outer container is removed or released, the headboards of the merchandise display modules may self-deploy to their deployed positions, optionally making visible the message regions 1209 of the headboards and/or optionally exposing the upper surface of the enclosures and/or the merchandise (not shown) contained in the enclosing space 1211. In embodiments, the cover of the outer container may also act as a headboard enhancing the visual impact of the overall display, and may include one or more message regions 1213.

In embodiments, also provided herein is a method of merchandising, including displaying merchandise in a self-deploying merchandise display module according to the disclosure hereof. The merchandise may include any one or more articles or products capable of being disposed in a merchandise display module. In embodiments, the merchandise may typically include a consumer product, and/or the display may be all or part of a retail display, which may include a point of purchase display.

Further Embodiments

In embodiments, also provided is a self-deploying merchandise display module including an enclosure defining an enclosing space for enclosing an article of merchandise, a headboard positionably mounted to the enclosure and positionable in at least either of a first position or a second position relative to the enclosure, and at least one spring actuator including a shape memory alloy (SMA) material and engaging the headboard, wherein the headboard is positionable from the first position to the second position by the action of the spring actuator. A self-deploying merchandise display module may include an article of merchandise disposed in the enclosing space. In embodiments of a self-deploying merchandise display module, a spring actuator may include a superelastic SMA material. A SMA material may include nitinol and/or may exhibit superelasticity at about 21 degrees Celsius.

In embodiments of a self-deploying merchandise display module, the strain on the SMA material when a headboard is in the first position may be less than the maximum recoverable superelastic strain limit of the SMA material under the conditions of normal use. In embodiments of a self-deploying merchandise display module, a spring actuator may consist in whole or part of a simple spring, such as, for example, a SMA wire or ribbon of simple, non-coiled geometry. In embodiments of a self-deploying merchandise display module, the maximum bend radius of the SMA spring actuator when a headboard is in the first position may be less than about 12 times the thickness of the SMA material. In embodiments of a self-deploying merchandise display module, the maximum bend radius of the SMA material when a headboard is in the first position may be less than about 1 cm. In embodiments of a self-deploying merchandise display module, the SMA material may include a wire or ribbon and the orientation of a headboard in the first position may differ from the orientation thereof in the second position by at least 75 degrees in the plane of action of at least one spring actuator.

In embodiments of a self-deploying merchandise display module, a headboard may include a message region such that the message region is not exposed when the headboard is in the first position and the message region is exposed when the headboard is positioned in the second position. In embodiments of a self-deploying merchandise display module, a spring actuator may include a superelastic SMA wire or ribbon affixed to or embedded in the material of a headboard. In embodiments of a self-deploying merchandise display module, a spring actuator may include a superelastic SMA wire or ribbon having an actuating portion affixed to or embedded in a headboard and an anchoring portion held in a fixed position relative to an enclosure, or having an anchoring portion affixed to or embedded in a portion of the headboard proximal to the enclosure and an actuating portion affixed to or embedded in a portion of the headboard distal to the anchoring portion.

In embodiments, also provided herein is a merchandise display system, including an outer container and a plurality of self-deploying merchandise display modules disposed in the outer container, wherein the headboard of each of the plurality of self-deploying merchandise display modules is constrained to the first position. In an embodiment of a merchandise display system, the outer container may includes a closure constraining the headboards of the self-deploying merchandise display modules in the first position thereof, so that upon opening or removal of the closure the headboards of the plurality of self-deploying merchandise display modules self-deploy to the second position under the action of the spring actuators of the self-deploying merchandise display modules.

In embodiments, also provided herein is a method of merchandising, including displaying a self-deploying merchandise display module in a retail or point of purchase display. In embodiments of a method of merchandising, a self-deploying merchandise display module may have disposed therein merchandise which may include a consumer product.

In embodiments, also provided herein is a method of packaging, including, in a container, disposing a plurality of self-deploying merchandise display modules, wherein the headboards of each of the self-deploying merchandise display modules are constrained in the first position.

In embodiments, also provided herein is a method of packaging an article of merchandise, including: disposing the article of merchandise in a self-deploying merchandise display module.

In embodiments, also provided herein is a self-deploying merchandise display module including an electrically powered component, and further including a sensor configured and adapted to activate the electrically powered component upon self-deployment of a headboard to the second position.

In embodiments, also provided herein are self-deploying merchandise display modules, including a package portion including an enclosing space for containing an article of merchandise, a deployable portion positionable in at least a first position and a second position relative to the package portion, and a positioning component operable to position the deployable portion from the first position to the second position.

In embodiments, also provided herein is a method of packaging merchandise, including: in an outer container having a cover, disposing a plurality of self-deploying merchandise display modules according to the disclosure hereof, and positioning the cover to constrain the headboard of each of the self-deploying merchandise display modules in their undeployed position.

In embodiments, also provided herein is a method of merchandising including disposing in a merchandise display at least one article of merchandise packaged in a self-deploying merchandise display module according to the disclosure hereof.

In embodiments, also provided herein is a method of packaging including disposing an article of merchandise in a self-deploying merchandise display module or merchandise display system.

CONCLUDING MATTER

Except as otherwise explicitly stated, an embodiment of an apparatus or object is described herein in an orientation as in normal use according to the disclosure hereof and/or as depicted in the drawing figures, with "lower side" referring to the portion generally oriented downward, and "upper side" referring to the generally upwardly oriented portion. "Upward" and "downward" refer to the upward and downward directions relative to the apparatus or object when oriented generally as in normal use and/or as illustrated in the drawing figures. "Lateral" and "horizontal" refer to the spatial dimensions generally perpendicular to the "upward" and "downward" directions. "Vertical" refers to the generally upward/downward direction. "Inward" and "outward" refer respectively to lateral directions generally toward and away from a generally vertical axis passing through the centroid or center of mass of the apparatus or object. "Front" and "rear" refer respectively to portions of an object facing generally toward or away from a user in normal use of the object as disclosed herein. "Left" and "right" refer respectively to the left or right portions of an object when viewed from the front. The foregoing directional and/or orientation terms are employed for convenience so as not to overly complicate the description. Except as otherwise explicitly stated, the objects described may be positioned in any orientation operable for an application of interest. Thus, by way of example only, a merchandise display module and/or merchandise display system could be positioned in a slanted or vertical orientation rather than a horizontal orientation as shown in the drawing figures. Except as otherwise specifically stated or required by context, directional terms are not intended to be limiting or to imply that the apparatus or object must be used in any particular position or orientation.

In embodiments, components and/or substructures described herein as having fixed positions relative one to another may be held in position in any manner operable to maintain the specified positions under conditions of normal use as described herein, such as, by way of example only, by the use of mechanical fasteners such as bolts, screws, nuts, or rivets; by heat, such as, for example, welding, brazing, or soldering; by an adhesive; by incremental deposition, such as, for example, by 3D printing; and/or by forming a component integrally or as a single piece with another component. In embodiments, components and/or substructures described herein as having movable positions relative one to another may be constrained in position in any manner operable to constrain the components and/or substructures within the specified ranges of positions under conditions of normal use as described herein, such as, by way of example only, by the use of mechanical fasteners such as hinges, sliders, tracks, followers, pivots, bearings, and/or flexible components. Unless otherwise specifically stated or required by context, mounting and/or affixation may be permanent or removable or removable and replaceable, as deemed useful for an application of interest.

For clarity and to ensure completeness, certain of the aspects and/or embodiments disclosed herein may be overlapping in scope, described repetitively, or represent recitals of the same or equivalent elements or combinations expressed in alternative language. It will be apparent that the choice of particular phraseology and/or of particular aspects or elements to assert as claims involves many complex technical and legal considerations, and no inference should be drawn that alternative descriptions of a particular element or combination in this written description necessarily do or do not encompass different subject matter; except where context otherwise requires, each described aspect or element should be interpreted according to its own description.

It is intended that this specification be interpreted in accordance with the normal principles of English grammar and that words and phrases be given their ordinary English meaning as understood by persons of skill in the pertinent arts except as otherwise explicitly stated. If a word, term, or phrase is intended to be further characterized, specified, or narrowed in some way, then additional adjectives, modifiers, or descriptive text have been included in accordance with the normal principles of English grammar. It is intended that the meanings of words, terms, or phrases should not be modified or characterized in a manner differing from their ordinary English meaning as understood by persons of skill in the relevant arts except on the basis of adjectives, modifiers, or descriptive text that is explicitly present.

Except as otherwise explicitly stated, terms used in this specification, including terms used in the claims and drawings, are intended as "open" terms. That is, for example, the words "including" and "comprising" should be interpreted to mean "including but not limited to," the word "having" should be interpreted to mean "having at least," the word "includes" should be interpreted to mean "includes but is not limited to," the phrases "for example" or "including by way of example" should be interpreted as signifying that the example(s) given are non-exhaustive and other examples could be given, and other similar words and phrases should be given similar non-exclusive meanings. Except as explicitly stated, ordinals used as adjectives (e.g. "first object", "second object", etc.) in this specification, including claims and drawing figures, are intended merely to differentiate and do not imply that any particular ordering is required. Thus, for example, unless otherwise explicitly stated, "first measurement" and "second measurement" do not imply that the first measurement necessarily takes place before the second measurement, but merely that they are distinct measurements.

In the written description and appended claims, the indefinite articles "a" and/or "an" are intended to mean "at least one" or "one or more" except where expressly stated otherwise or where the enabling disclosure requires otherwise. The word "or" as used herein is intended to mean "and/or", except where it is expressly accompanied by the word "either", as in "either A or B". Applicants are aware of the provisions of 35 U.S.C. § 112(f). The use of the words "function," "means" or "step" in the written description, drawings, or claims herein is not intended to invoke the provisions of 35 U.S.C. § 112(f), to define the invention. To the contrary, if the provisions of 35 U.S.C. § 112(f) are sought to be invoked, the claims will expressly include one of the exact phrases "means for performing the function of" or "step for performing the function of". Moreover, even if the provisions of 35 U.S.C. § 112(f) are explicitly invoked to define a claimed invention, it is intended that the claims not be limited only to the specific structure, material or acts that are described in the preferred embodiments, but in addition, extend to any and all structures, materials or acts that perform the claimed function as described in alternative embodiments or forms of the invention, or that are well known present or later-developed equivalent structures, material or acts for performing the claimed function.

Any of the methods of the present disclosure may be implemented in whole or part in hardware, software, or both, or by a computer program, and may be carried out using any of the disclosed devices or apparatus according to any aspect or embodiment of the present invention, or in any other operable manner.

In the foregoing description, various details, specific aspects, embodiments, and examples have been described in order to illustrate and explain the subject matter, to provide a thorough understanding of the various aspects, to enable persons skilled in the pertinent arts to practice the described subject matter, and to disclose the best mode of doing so known to applicants. These details, specific aspects, embodiments, and examples are not intended to be limiting; rather, it will be apparent to persons of skill in the relevant arts that, based upon the teachings herein, various changes, substitutions, modifications, rearrangements, may be made and various aspects, components, or steps may be omitted or added, without departing from the subject matter described herein and its broader aspects. Except as otherwise expressly stated or where aspects or features are inherently mutually exclusive, aspects and features of any embodiment described herein may be combined with aspects and features of any one or more other embodiments. Titles, headings, and subheadings herein and the abstract hereof are intended merely as a convenience for indicating the general nature of subject matter, and do not limit or otherwise affect the interpretation of the content of the disclosure. The appended claims are intended to encompass within their scope any and all changes, substitutions, modifications, rearrangements, combinations of aspects or features, additions, and omissions that are within the spirit and scope of the subject matter as described herein and/or within the knowledge of a person of skill in the art. The scope of the invention is defined by the claims, and is not limited by or to the particular embodiments or aspects chosen for detailed exposition in the foregoing description, but rather extends to all embodiments or aspects as defined by the claims, as well as any equivalents of such embodiments or aspects, whether currently known or developed in the future.

So as to reduce the complexity and length of the detailed description, and to provide background in certain areas of technology, each of the materials identified in the "REFERENCES" section below is expressly incorporated by reference. Applicants believe that the subject matter incorporated is "non-essential" in accordance with 37 CFR 1.57, because it is referred to for purposes of indicating the background of the invention or illustrating the state of the art. However, if the Examiner concludes that any of the incorporated material constitutes "essential material" within the meaning of 37 CFR 1.57(d)(1)-(3), applicants will amend the specification to expressly recite the essential material that is incorporated by reference as allowed by the applicable rules.

REFERENCES

1. Ambrose, Gavin, Packaging the Brand: The Relationship Between Packaging Design and Brand Identity, AVA Publishing 2011, ISBN 2940411417.
2. DePuis, Steven and Silva, John, Package Design Workbook, The Art And Science of Successful Packaging, Rockport Publishers 2011, ISBN 1592533221.
3. Ellicott, Candace and Roncarelli, Sarah, Packaging Essentials: 100 Design Principles for Creating Packages, Rockport Publishers 2010, ISBN 1592536034.
4. Jackson, Paul, Structural Packaging, Laurence King Publishing 2012, ISBN 1856697533.
5. Keller, Aaron, Design Matters: Packaging 01: An Essential Primer for Today's Competitive Market, Rockport Publishers 2008, ISBN 1592533426.
6. Klimchuk, Marianne and Krasovec, Sandra, Packaging Design: Successful Product Branding From Concept to Shelf, Wiley, 2d Ed. 2013, ISBN 111802706X.
7. Lawson, Benjamin C., Shape Memory Alloys, Muscle Wires and Robotics, Capitol Publishers, LLC (May 23, 2016), ASIN B01G45ZXFG.
8. Lecce, Leonardo, Shape Memory Alloy Engineering: For Aerospace, Structural and Biomedical Applications, Butterworth-Heinemann 2014, ISBN 0080999204.
9. Lexcellent, Christian, Shape-Memory Alloys Handbook, Wiley-ISTE 1st ed. 2013, ISBN 1848214340.
10. Pegler, Martin M., Visual Merchandising & Display, Fairchild Pubns 5th Ed. 2006, ISBN 1563674459.
11. POP Display Design, Azur Corporation 2011, ISBN 4568504341.
12. Rao, Ashwin and A. R. Srinivasa, J. N. Reddy, Design of Shape Memory Alloy (SMA) Actuators, Springer, 2015, ISBN 3319031872.
13. Shepard, Judy, New Trends in Visual Merchandising: Retail Display Ideas that Encourage Buying, RSD Publishing 2012, ISBN 0985467401.
14. Stahlberg, Marcus and Maila, Ville, Shopper Marketing: How to Increase Purchase Decisions at the Point of Sale, Kogan Page 2d Ed 2012, ISBN 0749464712.
15. University of Cambridge, Superelasticity—Strain Accommodation by Martensite Formation, www.doitpoms.ac.uk/tlplib/superelasticity/superelasticity1.php, created Aug. 6, 2009, accessed Dec. 27, 2016.

What is claimed is:

1. A merchandise display system comprising:

an outer container comprising a closure;

a plurality of self-deploying merchandise display modules disposed in the outer container, each self-deploying merchandise display module comprising an enclosure defining an enclosing space for enclosing an article of merchandise, a headboard positionably mounted to the enclosure and positionable in at least either of a first position or a second position relative to the enclosure, and at least one spring actuator comprising a shape memory alloy (SMA) material and engaging the headboard, wherein the headboard is positionable from the first position to the second position by the action of the at least one spring actuator;

wherein the headboard of each of the plurality of self-deploying merchandise display modules is constrained to the first position by the closure of the outer container.

2. The merchandise display system of claim 1, wherein each of the plurality of self-deploying merchandise display modules further comprises an article of merchandise disposed in the enclosing space.

3. The merchandise display system of claim 1, wherein the at least one spring actuator of each of the plurality of self-deploying merchandise display modules comprises a superelastic SMA material.

4. The merchandise display system of claim 1, wherein the SMA material comprises nitinol.

5. The merchandise display system of claim 1, wherein the SMA material exhibits superelasticity at about 21 degrees Celsius.

6. The merchandise display system of claim 1, wherein when the headboard of a self-deploying merchandise display module is in the first position the strain on the SMA material of the at least one spring actuator thereof is less than the maximum recoverable superelastic strain limit of the SMA material under the conditions of normal use.

7. The merchandise display system of claim 1, wherein the at least one spring actuator of each of the plurality of self-deploying merchandise display modules comprises a simple spring.

8. The merchandise display system of claim 1, wherein the maximum bend radius of the at least one SMA spring actuator of each of the plurality of self-deploying merchandise display modules is less than about 12 times the thickness of the SMA material when the headboard is in the first position.

9. The merchandise display system of claim 1, wherein the maximum bend radius of the at least one spring actuator of each of the plurality of self-deploying merchandise display modules is less than about 1 cm when the headboard is in the first position.

10. The merchandise display system of claim 1, wherein the at least one spring actuator of each of the plurality of self-deploying merchandise display modules comprises a simple spring comprising SMA wire or ribbon and the orientation of the headboard of each of the plurality of self-deploying merchandise display modules in the first position differs from the orientation of the headboard in the second position by at least 75 degrees in the plane of action of at least one spring actuator.

11. The merchandise display system of claim 1, wherein the headboard of each of the plurality of self-deploying merchandise display modules comprises a message region and the message region is not exposed when the headboard is in the first position and the message region is exposed when the headboard is positioned in the second position.

12. The merchandise display system of claim 1, wherein the at least one spring actuator of each of the plurality of self-deploying merchandise display modules comprises a superelastic SMA wire or ribbon affixed to or embedded in the material of the headboard.

13. The merchandise display system of claim 1, wherein the outer container comprises a closure constraining the headboards of the self-deploying merchandise display modules in the first position thereof, and upon opening or removal of the closure the headboards of the plurality of self-deploying merchandise display modules self-deploy to the second position under the action of the spring actuators of the self-deploying merchandise display modules.

14. A method of packaging, comprising: in a container comprising a closure, disposing a plurality of self-deploying merchandise display modules, each self-deploying merchandise display module comprising an enclosure defining an enclosing space for enclosing an article of merchandise, a headboard positionably mounted to the enclosure and positionable in at least either of a first position or a second position relative to the enclosure, and at least one spring actuator comprising a shape memory alloy (SMA) material and engaging the headboard, wherein the headboard is positionable from the first position to the second position by the action of the at least one spring actuator; wherein the headboards of each of the self-deploying merchandise display modules are constrained in the first position by the closure of the container.

* * * * *